US005414936A

United States Patent [19]

Sappington

[11] Patent Number: 5,414,936

[45] Date of Patent: May 16, 1995

[54] ADJUSTABLE ARCHERY SIGHT

[75] Inventor: Donald R. Sappington, Lake St. Louis, Mich.

[73] Assignee: Toxonics Manufacturing, Inc., Wentzville, Mo.

[21] Appl. No.: 127,041

[22] Filed: Sep. 27, 1993

[51] Int. Cl.[6] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 3,787,984 | 1/1974 | Bear et al. | 33/265 |
| 3,854,217 | 12/1974 | Killian | 33/265 |
| 3,864,836 | 2/1975 | Haines | 33/265 |
| 4,020,560 | 5/1977 | Hezk | 33/265 |
| 4,136,461 | 1/1979 | Gasser | 33/265 |
| 4,457,076 | 7/1984 | Heck | 33/265 |
| 4,481,717 | 11/1984 | Kowalski | 33/265 |
| 4,535,747 | 8/1985 | Kudlacek | 33/265 |
| 4,625,421 | 12/1986 | Strauss | 33/265 |
| 4,757,614 | 7/1988 | Kudlacek | 33/265 |
| 4,761,888 | 8/1988 | Kudlacek | 33/265 |
| 5,072,716 | 12/1991 | Sappington | 124/87 |
| 5,174,269 | 12/1992 | Sappington | 124/87 |
| 5,289,814 | 3/1994 | Maisano | 33/265 |

*Primary Examiner*—Thomas B. Will
*Attorney, Agent, or Firm*—Paul M. Denk

[57] ABSTRACT

An adjustable archery sight assembly which may be secured to an archery bow for use in target shooting includes a generally horizontal bar removably and slidably secured to the bow, a generally vertical arm removably secured to the horizontal bar at a proximal end thereof, a block slidably mounted to the vertical arm; and a sight pivotally and slidably secured to the block. The vertical arm defines a generally vertical path defined by a depression formed in the vertical arm and having beveled edges. The block slides within said path and has ears which have beveled edges formed complementary to the bevelled edges of the depression. The use of the parallel bevelled edges keeps the block, and hence the sight, in alignment when the sight is moved along the path of the vertical arm.

16 Claims, 3 Drawing Sheets

ADJUSTABLE ARCHERY SIGHT

BACKGROUND OF THE INVENTION

This invention relates to adjustable archery bow sights, and, in particular, to a bow sight assembly which will maintain alignment of the sight when the sight is moved vertically.

When an archer shoots at targets, as opposed to game, he uses a detailed sight to aim his bow. For the sighting to be accurate, the sight must be accurately aligned. Sights are often moved vertically to adjust to a change in distance to the target. To move the sight requires that a screw be loosened, that the sight be moved to its new desired position, and that the screw be retightened. However, when the screw is loosened, and then again retightened, the sight may come out of alignment. This, thus, requires that the sight be realigned before it can again be accurately used.

One object of this invention therefore is to provide a bow sight assembly which may be aligned.

Another object is to provide such an assembly which does not come out of alignment when the sight is moved along a vertical path.

A further object of this invention is to provide an archery sight which can be moved in six different directions to provide for its thoroughly accurate sighting upon the target.

These and other objects will become apparent to those skilled in the art upon review of the following disclosure and accompanying drawings.

SUMMARY OF THE INVENTION

In accordance with this invention, generally stated, the archery sight of the present invention includes a generally horizontal bar removably secured to said bow, a generally vertical carriage secured to said horizontal bar at a proximal end thereof, a slide slidably mounted to said carriage; and a sight secured to said slide. The slide and carriage cooperates so that when the sight, mounted on the slide, is moved on the carriage, the alignment of the sight is maintained so that the sight does not have to be realigned each time the sight is moved. The carriage defines a track having beveled edges formed on thereon and beveled edges are formed on the slide which are complementary shaped to, and cooperate with, the beveled edges of the carriage track. Specifically, the carriage defines two tracks on opposite sides thereof, each track having beveled edges. Preferably, one of the tracks is a raised track and the other is a sunken track. Two slides are provided, one for each track. Each slide has beveled surfaces to cooperate with the track on which it slides.

DESCRIPTION OF THE PREFERRED EMBODIMENT

Figure 1:
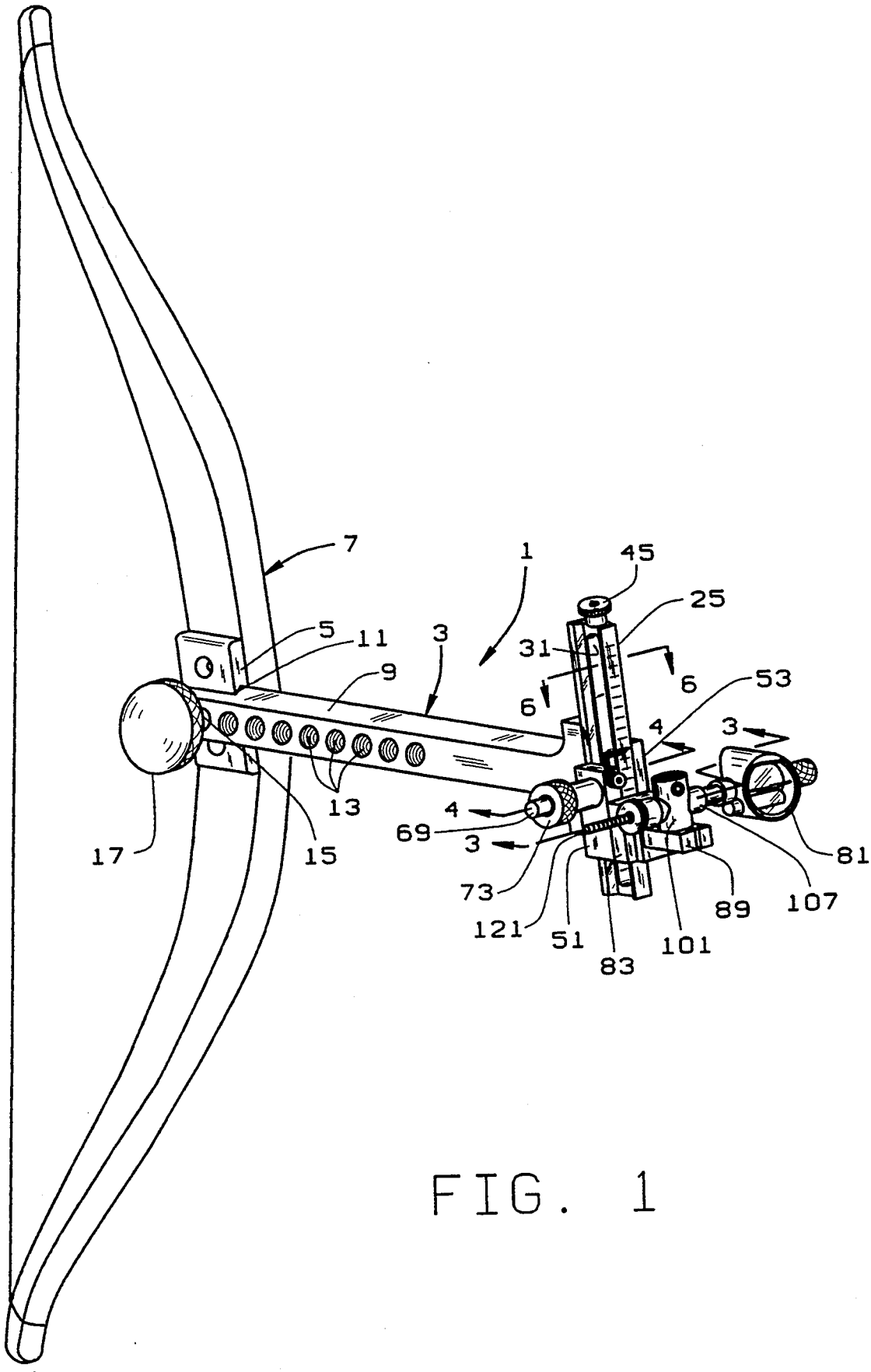
FIG. 1 is a perspective view of an illustrative bow sight assembly of the preset invention.

Referring initially to FIG. 1, an adjustable bow sight assembly of the present invention is shown generally at 1. Assembly 1 includes an arm 3 which is slidably received in a bracket 5 which is secured to a bow 7, as is generally known. Arm 3 has outwardly beveled edges 9 which are received in a complementary shaped groove 11 in bracket 5. The beveled shape of arm 3 creates a dove tailed mortise and tenon like mount. The cooperation between them prevents rotation of arm 3 about its longitudinal axis.

Arm 3 has a plurality of threaded openings 13 which receive a screw 15 having a knurled cap 17. Screw 15 extends through a selected hole 13 and into a hole 16 in bracket 5 to secure assembly 1 to bow 7. Screw 15 steps at its end as at 19 to a smaller diameter non-threaded section. It is this portion of the screw 15 that is received in hole 16. The position of bow sight assembly 1 is easily changed by unscrewing screw 15 sliding arm 3 until a desired hole 13 is aligned with the hole 16 in bracket 5, and screwing in screw 15 into the bracket to secure arm 3.

Arm 3 widens as at 21 to form a vertically extending mounting section 23 to which a carriage 25 is secured. Mounting section 23 has a pair of holes **24*a* and 24*b* at opposed ends thereof through which fasteners or bolts 26 pass to secure carriage 25 to section 23. Carriage 25 has a plurality of spaced screw holes (not shown) which receive the threaded shank of bolts 26 to secure carriage 25 to section 23. One of the bolt holes 24*b* is only slightly larger than the bolt shank to allow passage of the shank through the bolt hole. However, the other hole 24*a* is larger than the shank diameter. This allows for the carriage 23 to be pivoted a small degree about the bolt 26 which passes through hole 24*b*. This degree of pivot provided by the large hole aids in properly aligning the bow sight. The multiple holes on carriage 25 also allow the height of carriage 25 with respect to mounting section 23** to be changed.

Figure 6:
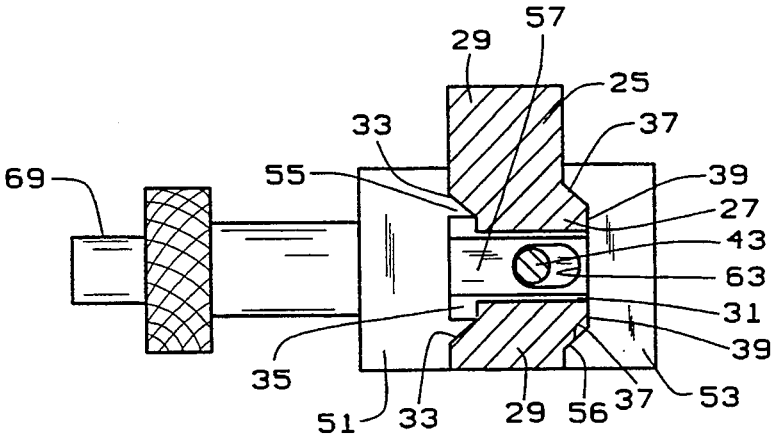
FIG. 6 is an enlarged cross-sectional view of the vertical movement assembly for the sight taken along line 6—6 of FIG. 1.

Carriage 25 has a web section 27 extending between the wall sections 29. The forward, or outer wall, 29 has markings 30 indicative of the distance to aid in the aiming of the bow. Web section 27 has an elongate opening 31 which extends the depth of web 27 and nearly the full length of web 27. Walls 29 have beveled edges 33 which extend outwardly from opening 31 to define a track 35. Walls 29 are also beveled on the sides opposite bevels 33 as at 37 to define raised track 39. (FIG. 6)

Web 27 has vertical bores 41 formed in its top and bottom. Holes 41 are centered with respect to opening 31. A screw 43 is rotatably journalled in web holes 41. A knurled knob 45 receives Screw 43 and allows a user to rotate screw 43. A ball 46 is biased by a spring 47 which is received in a blind bore 49 adjacent hole 47 in the top of web 27. Ball 46 interacts with depressions or sockets (not shown) on the underside of nut 45 to control rotation of screw 43. The structure of the underside of knob 45 is substantially similar to the dimpled surface of cylinder 107, which is described hereinafter. Ball 46 and the sockets in nut 45 provide discrete stops which prevent screw 43 from rotating undesirably. The ball and socket also enables knob 45 to be maintained in a desired position.

A slide 51 and a slide 53 are mounted to carriage 25 to move along tracks 35 and 39, respectively. Each slide has inner beveled edges 55 and 56, respectively, shaped complementary to the beveled edges 33 and 37 of tracks 35 and 39 so that the slides may move along carriage 25. Slide 53 has an opening 58 through which a block 57 extends. Opening 58 expands radially outwardly a surface 58*a* and has a step 58*b* extending upwardly from the surface 58*a* to the outer surface of slide 53. Block 57 has a cap 59 which seats on surface 58*a* inside of shoulder 58*b* and prevents block 57 from passing completely through slide 53 and an externally threaded portion 61 extending away from cap 59. An elongate vertical opening 63 is formed in block 57 so that screw 43 may pass therethrough. Opening 63 may have a threaded wall 65 which mates with the threads of screw 43.

Block 57 also has a longitudinal bore 62 perpendicular to opening 63. A shaft 67 is received in bore 62 of block 57. Shaft 67 passes through an opening 68 in slide 51 and through block bore 62 into block cap 59. Shaft 67 connects slides 51 and 53 to shat they move together and cooperate, as explained hereinafter, to hold the sight in a desired position of carriage 25. Shaft 67 has an elongate vertical opening 69 through which screw 43 passes. A wall 71 of shaft opening 67 is threaded to mate with the threads of screw 43. Threaded wall 71 is on an opposite side of threaded wall 65 of block 57. When in a normal position, shaft 67 and block 53 coact to create a threaded opening having the same diameter as screw 43 to threadably receive screw 43.

Shaft 67 has a cap 69 on its outer end which extends from hole 68 of slide 51 and and serves to hold a spring 70 on shaft 67 between cap 69 and the outer edge 72 of block portion 61. Spring biases shaft 67 and block 57 so that threaded walls 65 and 71 are normally in meshing contact with screw 43 creating the above noted threaded opening. By pressing on cap 69, shaft 67 and block 57 slide relative to each other enlarging the threaded opening to bring walls 65 and 71 out of meshing contact with screw 43. In this position, slides 51 and 53 can be moved along their respective tracks.

This structure allows for both fine and gross adjustments of the placement of slides 51and 53 on slide 25. By pressing on cap 69, the slides can be quickly moved along screw 43 to an approximate desired position. Then by releasing cap 69 to return the shaft and block to their normal positions. Screw 43 can be rotated using knob 45 to bring slides 51 and 53 to their exact desired position on slide 25.

A cap 73 having an internally threaded bore 75 is received on threaded portion 61. Cap 73, when tightened, pulls slides 51 and 53 toward each other to clamp them into position on carriage 25. When cap 73 is loosened, slides 51 and 53 are able to move slightly about the longitudinal axis of carriage 25. Cap 73, when tightened, prevents this action. When cap 73 is tightened, the beveled edges of the slides 51 and 53 move along the beveled tracks 35 and 39 to bring the slides to the same position relative to the lateral axis of carriage 25 each time the slides are moved. The cooperation of slides 51 and 53 with tracks 35 and 39 therefore ensure that the alignment of the sight is maintained when it is moved vertically on carriage 25.

A sight 81 is pivotally mounted to slide 51 to rotate on a vertical plane which is perpendicular to the longitudinal axis of arm 3. Sight 81 may be a sight such as may be obtained from companies such as the Brite-Side located in Succasunna, N.J. A first bracket 83 is fixed to slide 51. Bracket 83 is secured so that it will extend across the front of slide 25. The front of slide 25 typically has measuring marks corresponding to distance (i.e.; 50, 60, 70 yards etc.). By aligning a pin 84 with the marks, the sight 81 can be set for a desired distance, as is known. Pin 84 is secured to slide 51 by a screw 86. Bracket 83 has a hole 85 and groove 87 which extends from an edge of bracket 83 to hole 85. Groove 87 extends the full width of bracket 83 to create two lobes 88*a* and 88*b*. A second bracket 89 is received in bracket 83 and has a pin 91 which is received in hole 85 to rotationally mount bracket 89 to bracket 83. Bracket 83 has a screw 93 which may be tightened to clamp bracket 89 against pivotal movement by bringing lobes 88*a* and 88*b* toward each other. By loosening and tightening screw 93, bracket 89 may be pivoted to, and set in, a desired position.

Bracket 89 is configured similarly to Bracket 83 and has a hole 95, a groove 97 extending to hole 95 from an edge of bracket 89 and a screw hole 99. Like groove 87, groove 97 extends the full with of bracket 89 to create two lobes 98*a* and 98*b*. Bracket 89 receives a support 101 in which sight 81 is mounted. Support 101 has a pin 103 which is received in hole 95. Support 101 may pivot in hole 95 in horizontal plane parallel to the longitudinal axis of arm 3. By tightening screw 99 lobes 98*a* and 98*b* are brought toward each other and against pin 103 and support 101 can be fixed against rotation. By loosening and tightening screw 99, support 101 may be rotated to, and fixed in, a desired position.

Support 101 has a through bore 105 which receives a cylinder 107. Support 101 has a slot 109 through which a screw 111 extends. Screw 111 is tightened to securely fix cylinder 107 in support 101 to give the assembly an overall "T" shape as can be seen in FIG. 1.

Figure 2:
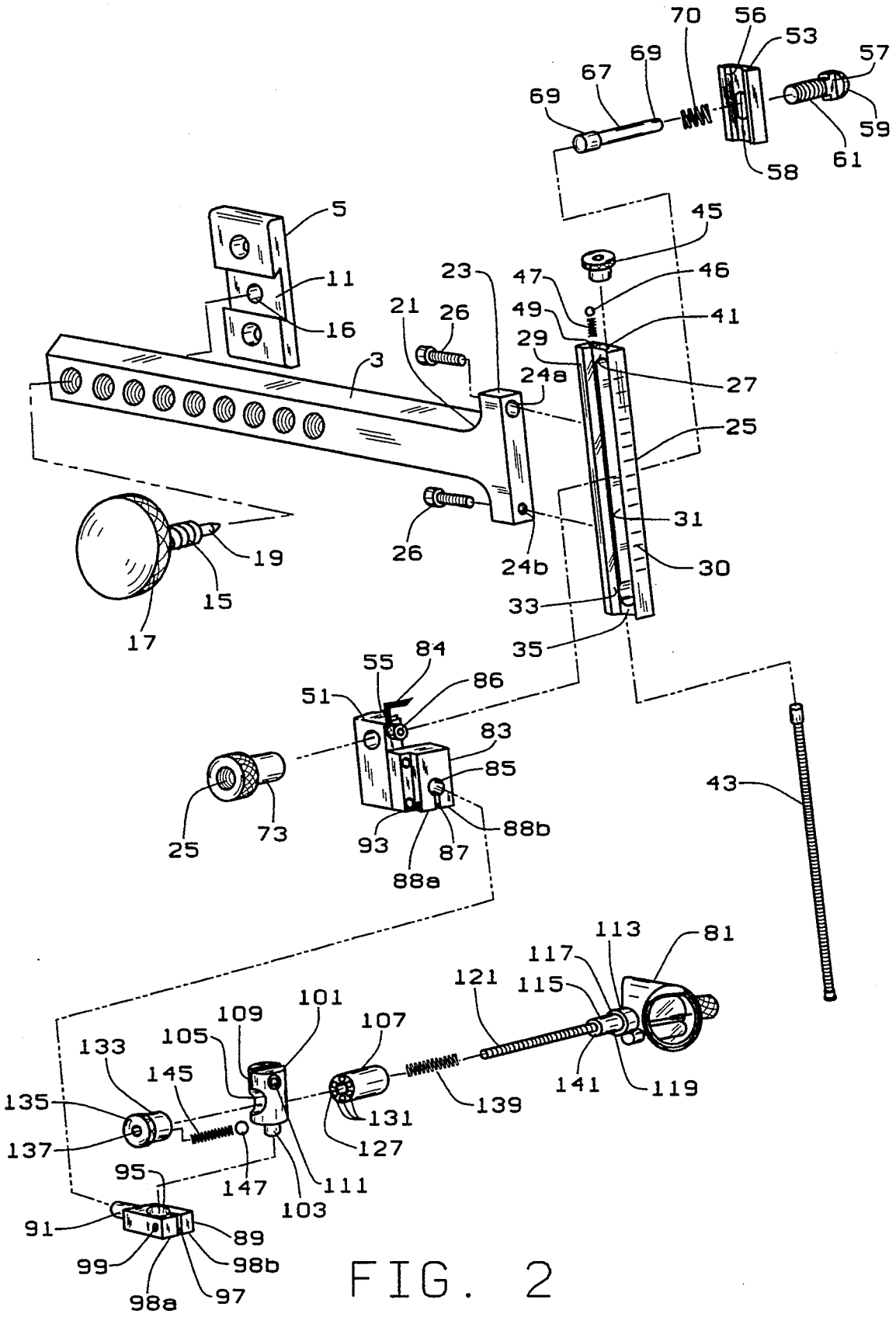
FIG. 2 is an exploded view of the bow sight.
Figure 3:
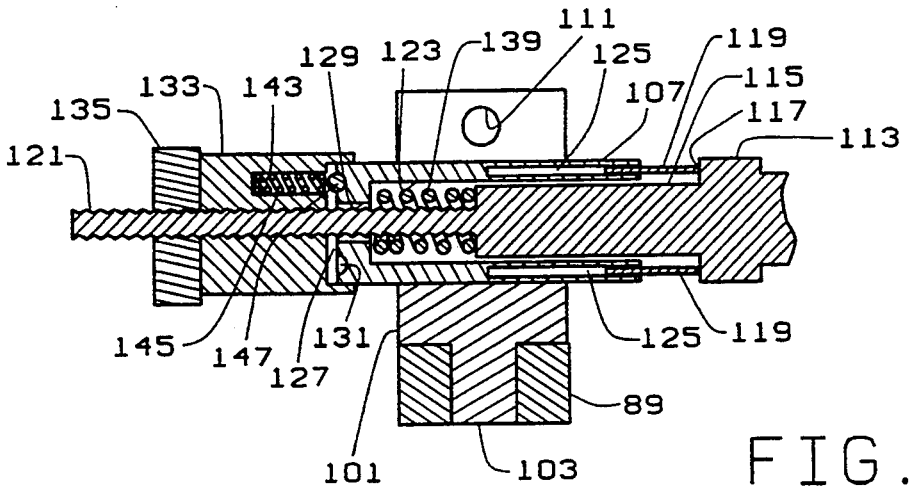
FIG. 3 is an enlarged cross-sectional view of the sight mounting assembly taken along line 3—3 of FIG. 1.
Figure 4:
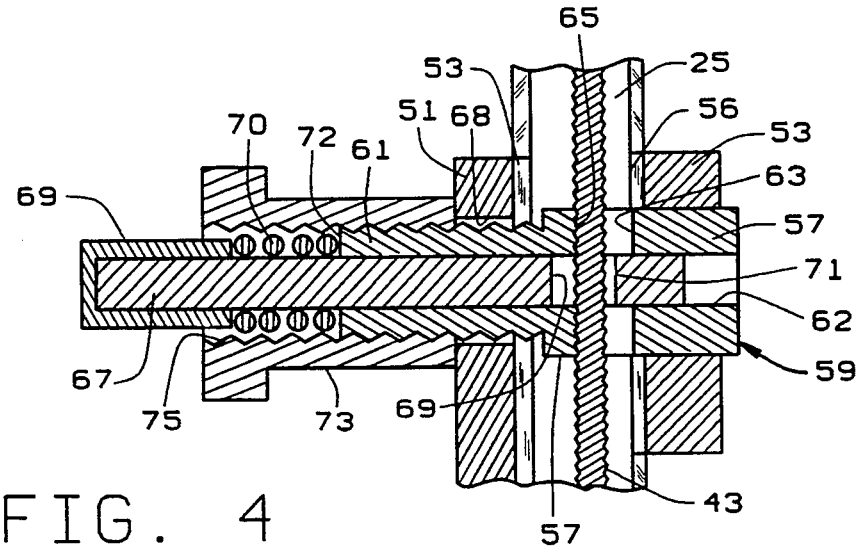
FIG. 4 is an enlarged cross-sectional view of the vertical movement assembly for the sight taken along line 4—4 of FIG. 1.
Figure 5:
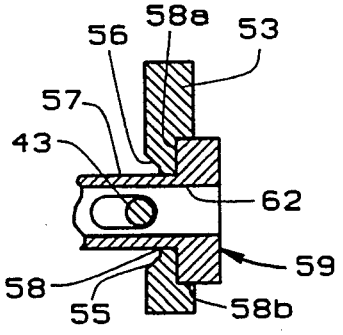
FIG. 5 is a cross-sectional view of a part of the vertical movement assembly.

Sight 81 has a cylindrical platform 113 from which an arm 115 extends. Arm 115 has a smaller diameter than base 113 and forms a shoulder 117 on base 113. A pair of pins 119 extend from shoulder 117 on opposite sides thereof. A screw 121 extends from arm 115. As seen in FIG. 3, arm 115 is received in a central bore 123 of cylinder 107 and pins 119 are received in blind bores 125. The cooperation of pins 119 and bores 125 prevent rotation of sight 81 with respect to cylinder 107. Cylinder 107 has a front end 127 which defines a smaller bore 129 through which screw 121 extends. Surface 127 also has a plurality of semi-circular depressions or sockets 131 formed in a circular pattern. (FIG. 2). A knob 133 having a knurled top 135 and a threaded bore 137 is received on screw 121. By rotating knob 133, sight 81 can be moved toward or away from cylinder 107. A spring 139 is received in bore 123 between end 127 and a shoulder 141 on arm 115. Spring 139 biases sight 81 outwardly so that the position of sight 81 does not change without rotation of knob 133. To prevent accidental rotation of knob 133 and hence accidental, unwanted adjustment of sight 81, knob 133 has an inner bore 143 which receives a spring 145 and a ball 147. Ball 147 is of the same radius as sockets 131 and is biased by spring 145 into sockets 131. The cooperation of spring biased ball 147 and sockets 143 create a ball and socket lock that prevents accidental rotation of knob 133.

As can be seen, the structure described provides multiple, at least approximately six, planes in which sight 81 can be adjusted. It can be moved axially toward and away from support 101 by knob 133 and screw 121. By loosening and tightening the screws of brackets 83 and 89, sight 81 can be moved in an axis perpendicular to and parallel to the longitudinal axis of arm 3. Sight 81 can be moved vertically along slide 25. By loosening the screws 26 which hold carriage 25 to arm 3, carriage 25 may be pivoted or rotated about the lower screw a distance defined by the size of the upper, larger opening 24*a*. And lastly, sight 81 can be moved toward or away from bow 7 by releasing arm 3 from bracket 5 and sliding it to a new desired position. In addition, other minor adjustments can be made, in that the sight 81 may be tilted or pivoted upwardly and downwardly, if necessary. Furthermore, by loosening the set screw 111, the support 101 may be pivoted about a vertical axis, to provide for the slight forward shifting or rearward shifting of the sight 81, mounted laterally thereof.

Once the sight 81 has been adjusted, it is important that the adjustment not be impaired when the sight is moved vertically on track 25. The use of the beveled tracks 35 and 39 prevent this. When the slides 51 and 53 are loosened to move sight 81, the sight moves slightly due to the looseness of the connection. However the cooperation of the beveled edges 55 and 57 of slides 51 and 53 with the tracks 35 and 39 brings the sight back to its original position in the plane parallel to the longitudinal axis of arm 3 when knob 73 is tightened. The tracks and slides prevent a significant alteration in the adjustment of sight 81 from occurring. Therefore, sight 81 does not have to be adjusted each time it is moved vertically. Rather, the setting of sight 81 by positioning brackets 83 and 89 and 101 need only be performed once. This saves significant time as the proper adjustment requires precise positioning of sight 81.

The foregoing description has been set forth for illustrative purposes only. Variations within 6he scope of the appended claims may be apparent to those skilled in the art. For example, support 101 could be mounted directly to slide 51. This of course, would eliminate two degrees of freedom of the sight. The mechanism allowing for both fine and gross adjustment of the vertical position could be modified, for example, to use a track rather than a screw. These examples are merely illustrative.

I claim:

1. An adjustable archery sight assembly which may be secured to an archery bow, said sight comprising:

a generally horizontal bar removably secured to said bow;

a generally vertical carriage secured to said horizontal bar at a proximal end thereof;

a slide slidably mounted to said carriage;

a sight secured to said slide;

means for maintaining the alignment of said sight, said alignment maintaining means comprising a track having doubled edges formed on said carriage and complementary formed beveled edges on said slide which cooperate with said carriage track;

said carriage has a first side and a second side, said sides being disposed on oppositely exposed sides of said carriage, each said side defining a track having beveled surfaces, said slide including a first slide having beveled edges which cooperate with the track of said first carriage side, and a second slide which cooperates with the track of the said second carriage side, said first and second slides being operatively connected for simultaneously biasing in opposite directions against their respective operative tracks on the carriage through a singular adjustment;

one of said first and second carriage tracks being a raised track, and the other of said first and second carriage tracks being a sunken track.

2. The sight assembly of claim 1 further including means for adjusting said horizontal bar along its longitudinal axis.

3. The sight assembly of claim 2 wherein said means for adjusting said horizontal bar include a mount removably secured to said bow, said horizontal arm being slidably mounted to said mount, and means for securing said horizontal arm in a desired position.

4. The sight assembly of claim 3 wherein said horizontal arm has a plurality of predefined openings, said mount defining an opening, said securing means including a removable fastener which passes through said openings to secure said arm in place.

5. The sight assembly of claim 3 wherein said mount defines a path through which said horizontal arm slides, said path being defined by a slot having inwardly beveled edges to form a generally trapezoidal path, said horizontal arm having beveled edges shaped complimentarily to said path.

6. The sight assembly of claim 1 wherein said carriage is removably secured to said horizontal bar, said horizontal bar having a head at its proximal end, said head defining bores, said carriage defining at least two bores on one side thereof, said carriage being vertically disposed and being secured to said head by fasteners which extend through said bores of said horizontal bar and said vertically disposed carriage.

7. The sight assembly of claim 6 wherein said carriage includes a plurality of spaced apart bores which may be aligned with said bores of said horizontal arm head, said plurality of bores defining means for mounting said vertically disposed carriage in a desired position.

8. The sight assembly of claim 7 wherein said carriage is pivotally mounted to said head of said horizontal bar.

9. The sight assembly of claim 8 wherein the bores of said head define a first bore and a second bore, said first bore and said second bore being in spaced apart relationship, one of said bores being larger than the other, the other bore being sized to accept the shank of a fastener.

10. The sight assembly of claim 6 further including means for positioning said slide at a desired location along said path of said carriage, said means including a bar mounted to said carriage parallel to said carriage path, said slide incorporating a block being movably mounted on said bar, and means for securing said block at said desired location.

11. The sight assembly of claim 10 wherein said bar is threaded and rotatably mounted to said carriage bar; said block defining a threaded throughbore through which said threaded bar extends; said securing means comprising said threaded bar and means for rotating said threaded bar; wherein said block and its slide is moved along said path by rotation of said threaded bar.

12. The sight assembly of claim 10 wherein said block defines an elongated slot through which said bar passes, said block including a spring biased lock movable between a locking position in which said block is secured in place and a moving position in which said lock is opened to allow movement of said block along said bar; and a button for moving said lock between its locking and moving positions; said lock being normally biased in its locking position.

13. The sight assembly of claim 6 wherein said sight is pivotally mounted to said block for rotation in a plane perpendicular to the longitudinal plane of said horizontal arm.

14. The sight assembly of claim 13 wherein said sight is slidably mounted on a second block for movement along a horizontal path parallel to the plane of rotation of said sight.

15. An adjustable archery sight assembly removably mounted to a bow, said sight assembly including:

an arm removably mounted to said bow;

a carriage mounted to said arm;

a sight movably mounted to said carriage;

a bracket mounted to said bow, said bracket receiving said arm, said arm being slidably axially in said bracket;

said carriage defines a vertical path, said sight being mounted to said carriage to move along said path;

said sight is mounted to a slide which is slidably secured to said carriage to move along said path;

said sight is carried by a bracket assembly, said bracket assembly having a first bracket mounted to said slide, said first bracket providing for rotation of said sight in a vertical plane parallel to said carriage path;

said bracket assembly further including a second bracket rotatably mounted in said first bracket, said second bracket providing for rotation of said sight in a horizontal plane parallel to said arm and perpendicular to said carriage path of travel; and said sight through its operative relationship with said various bracket and bracket assemblies having at least six degrees of freedom of movement in which it can be adjusted and aligned.

16. The adjustable archery sight of claim 15, said bracket assembly further including a third bracket rotatably mounted in said second bracket, said sight being mounted to said third bracket, said bracket providing for horizontal reciprocal motion of said sight perpendicular to the longitudinal axes of both said arm and said carriage.

* * * * *